US008955238B1

(12) United States Patent
Castruccio

(10) Patent No.: US 8,955,238 B1
(45) Date of Patent: Feb. 17, 2015

(54) ADJUSTABLE PLOW BLADE

(71) Applicant: John R. Castruccio, Alto, NM (US)

(72) Inventor: John R. Castruccio, Alto, NM (US)

( * ) Notice: Subject to any disclaimer, the term of this patent is extended or adjusted under 35 U.S.C. 154(b) by 0 days.

(21) Appl. No.: 14/306,578

(22) Filed: Jun. 17, 2014

Related U.S. Application Data

(63) Continuation-in-part of application No. 13/786,700, filed on Mar. 6, 2013.

(51) Int. Cl.
*E01H 5/06* (2006.01)

(52) U.S. Cl.
CPC ..... *E01H 5/065* (2013.01); *E01H 5/061* (2013.01)
USPC ..... 37/273; 37/231

(58) Field of Classification Search
USPC ..... 37/270, 265, 285, 266, 284, 272, 273, 37/278
See application file for complete search history.

(56) References Cited

U.S. PATENT DOCUMENTS

| | | | | | |
|---|---|---|---|---|---|
| 323,656 | A | * | 8/1885 | Franz | 37/274 |
| 2,754,602 | A | | 7/1956 | Gans | |
| 3,526,979 | A | * | 9/1970 | Ladewski | 37/273 |
| 3,898,753 | A | * | 8/1975 | Kinnunen | 37/273 |
| 3,994,081 | A | * | 11/1976 | Middleton | 37/273 |
| 4,074,448 | A | | 2/1978 | Niemela | |
| 4,130,952 | A | | 12/1978 | Dion | |
| 4,658,519 | A | | 4/1987 | Quenzi | |
| 4,910,893 | A | | 3/1990 | Asay | |
| 5,241,763 | A | | 9/1993 | Dynan | |
| 5,329,708 | A | * | 7/1994 | Segorski et al. | 37/231 |
| 5,410,824 | A | | 5/1995 | Pedersen | |
| 5,493,797 | A | | 2/1996 | Jackson | |
| 6,035,944 | A | | 3/2000 | Neuner | |
| 6,412,199 | B1 | | 7/2002 | Quenzi | |
| 6,449,882 | B2 | | 9/2002 | Kono | |
| 6,457,757 | B2 | | 10/2002 | Hendrick | |
| 6,474,007 | B1 | | 11/2002 | Sueshige | |
| 6,499,236 | B2 | | 12/2002 | Yoshida | |
| 6,513,267 | B2 | | 2/2003 | Yoshida | |
| 6,612,050 | B2 | | 9/2003 | Takeuchi | |
| 6,948,268 | B1 | | 9/2005 | Ronca | |
| 7,429,158 | B2 | | 9/2008 | McFarland | |
| 7,918,042 | B2 | | 4/2011 | Ropog | |
| 8,127,472 | B2 | | 3/2012 | Kotila | |
| 2001/0009079 | A1 | | 7/2001 | Kono | |
| 2001/0029685 | A1 | | 10/2001 | Hendrick | |
| 2002/0005001 | A1 | | 1/2002 | Yoshida | |
| 2002/0073581 | A1 | | 6/2002 | Takeuchi | |
| 2004/0060202 | A1 | | 4/2004 | Petruzzelli | |
| 2004/0140110 | A1 | | 7/2004 | Raup | |
| 2004/0244228 | A1 | | 12/2004 | Thaemert | |
| 2005/0160632 | A1 | | 7/2005 | Williams | |
| 2011/0239491 | A1 | | 10/2011 | Chen | |

* cited by examiner

*Primary Examiner* — Matthew D Troutman
(74) *Attorney, Agent, or Firm* — Neustel Law Offices

(57) ABSTRACT

An adjustable plow blade which is adapted to be easily reconfigured between multiple configurations, including a straight-blade configuration and a V-shaped configuration. The adjustable plow blade generally includes a pair of blade portions which are adapted to be removably secured to each other in various configurations including a straight-edge blade configuration and a V-shaped blade configuration. The blade portions each include linkages which may be utilized in connection with fasteners to transition the present invention between the configurations. A mount bar is also provided to which the blade portions are secured to mount the present invention to a plowing object such as a handheld snow plow.

12 Claims, 5 Drawing Sheets

ADJUSTABLE PLOW BLADE

CROSS REFERENCE TO RELATED APPLICATIONS

I hereby claim benefit under Title 35, United States Code, Section 120 of U.S. patent application Ser. No. 13/786,700 filed Mar. 6, 2013. This application is a continuation-in-part of the Ser. No. 13/786,700 application. The Ser. No. 13/786,700 application is currently pending. The Ser. No. 13/786,700 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a plow blade and more specifically it relates to an adjustable plow blade which is adapted to be easily reconfigured between multiple configurations, including a straight-blade configuration and a V-shaped configuration.

2. Description of the Related Art

Any discussion of the related art throughout the specification should in no way be considered as an admission that such related art is widely known or forms part of common general knowledge in the field.

Plow blades are utilized on a wide range of vehicles and tool to aid in moving various types of materials. For example, plow blades are commonly used on a tractor for moving debris to various locations. Plow blades are also commonly used on snow-moving tools, such as a handheld snow plow as shown and described in U.S. patent application Ser. No. 13/786,700.

While plow blades have improved over the years, they are generally difficult to connect and disconnected from tools and/or vehicles. Additionally, plow blades are typically comprised of a fixed configuration and are not adjustable into multiple configurations to suit different applications. Where such adjustments are possible, they are often unnecessarily complicated for the common user to perform.

Because of the inherent problems with the related art, there is a need for a new and improved adjustable plow blade which is adapted to be easily reconfigured between multiple configurations, including a straight-blade configuration and a V-shaped configuration.

BRIEF SUMMARY OF THE INVENTION

The invention generally relates to a plow blade which includes a pair of blade portions which are adapted to be removably secured to each other in various configurations including a straight-edge blade configuration and a V-shaped blade configuration. The blade portions each include linkages which may be utilized in connection with fasteners to transition the present invention between the configurations. A mount bar is also provided to which the blade portions are secured to mount the present invention to a plowing object such as a handheld snow plow.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
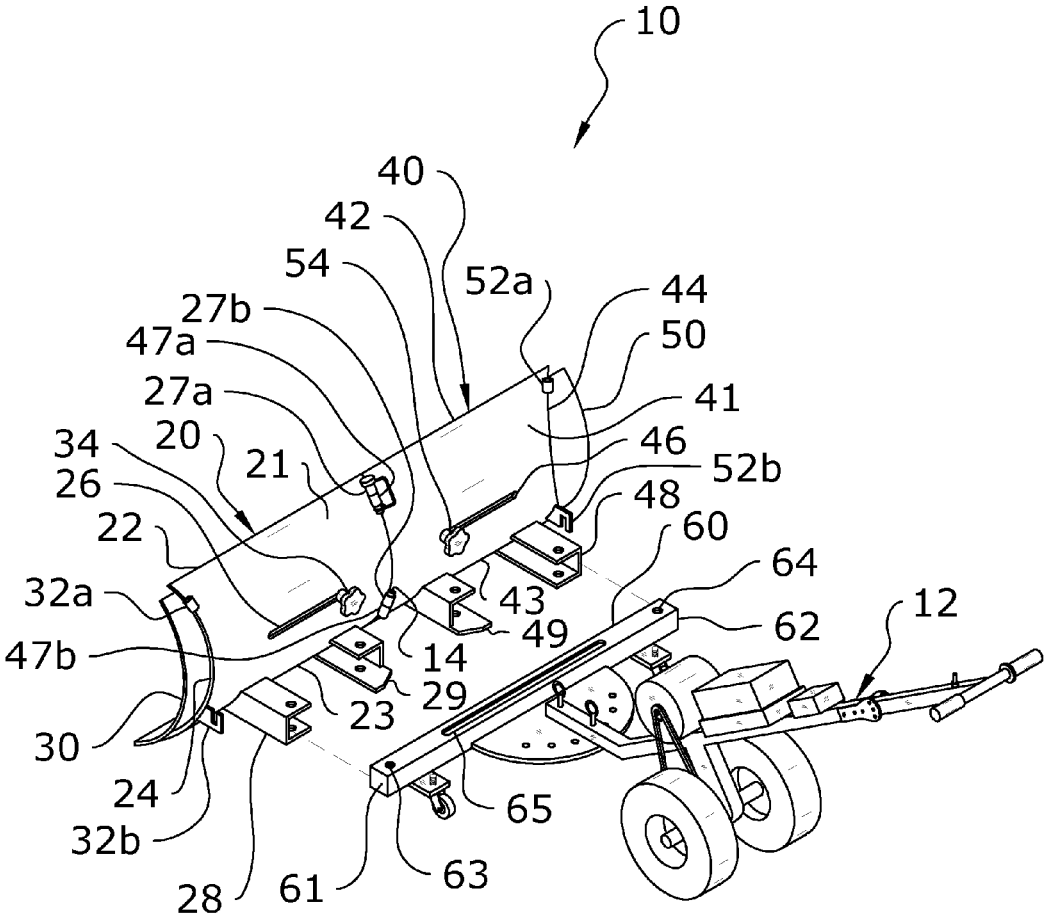
FIG. 1 is an upper perspective view of the present invention aligned for installation to a handheld snow plow.

A. Overview.

Turning now descriptively to the drawings, in which similar reference characters denote similar elements throughout the several views, FIGS. 1 through 5 illustrate a adjustable plow blade 10, which comprises a pair of blade portions 20, 40 which are adapted to be removably secured to each other in various configurations including a straight-edge blade configuration and a V-shaped blade configuration. The blade portions 20, 40 each include linkages 27, 32, 47, 52 which may be utilized in connection with fasteners 14 to transition the present invention between the configurations. A mount bar 60 is also provided to which the blade portions 20, 40 are secured to mount the present invention to a plowing object 12 such as a handheld snow plow.

B. Blade Portions.

As shown throughout the figures, the present invention generally comprises a pair of blade portions 20, 40 which are removably secured to each other in various manners to achieve the multiple configurations of the present invention. It should be appreciated that the figures merely illustrate an exemplary configuration for the first blade portion 20 and the second blade portion 40, and thus the scope of the present invention should not be construed as being limited to any particular size, shape, or configuration of the blade portions 20, 40.

Figure 5:
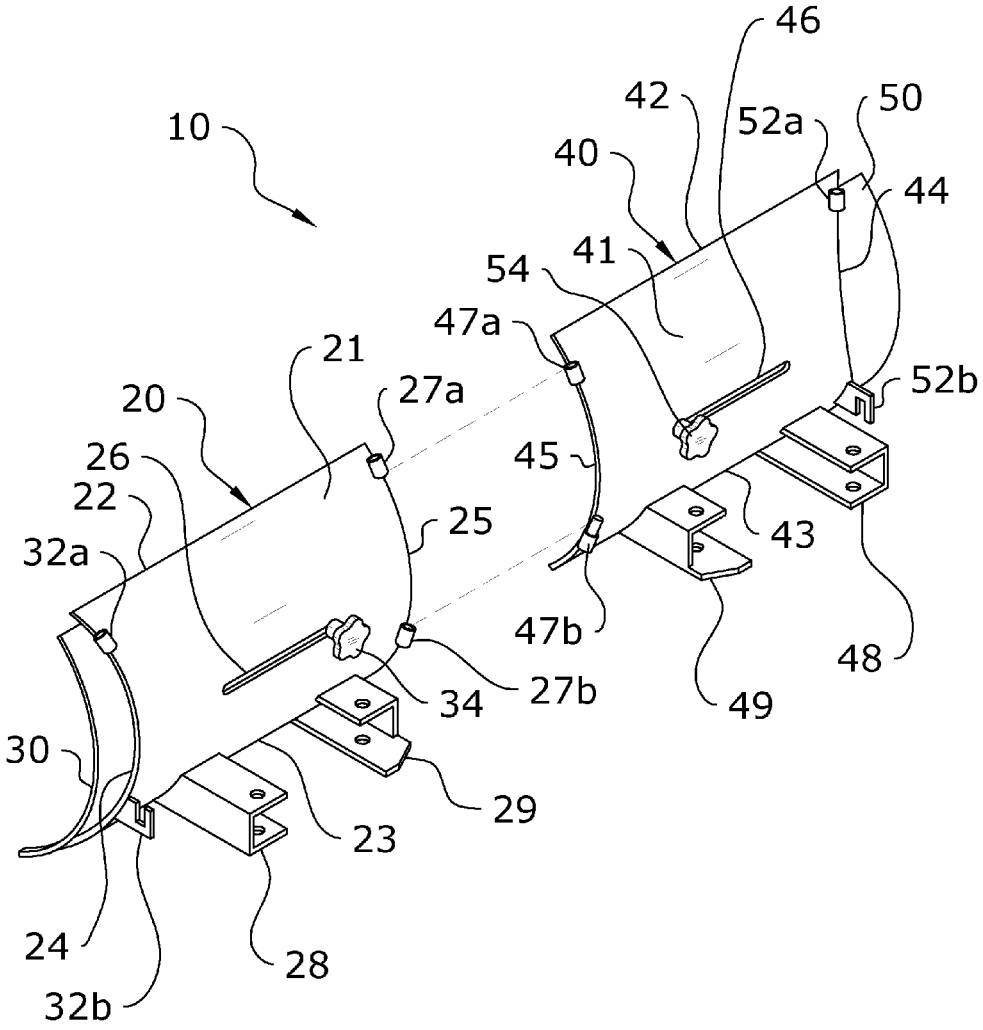
FIG. 5 is an upper perspective view of the present invention with the first and second blade portions being separated.

As best shown in FIG. 5, the first blade portion 20 comprises a first blade backing 21 comprised of a curved blade configuration having an upper end 22, a lower end 23, a first side 24, and a second side 25. A first slot 26 extends through the first blade portion 20 between its first side 24 and its second side 25 in parallel relationship with the upper and lower ends 22, 23. The first slot 26 receives the first adjustment knob 34 of the first adjustment blade 30 and is utilized to make adjustments thereto.

The first blade portion 20 includes one or more first linkages 27*a,b* extending from its second side 25 and one or more third linkages 32*a,b* extending from its first side 24 as shown in FIG. 1 for removably securing the first blade portion 20 to the second blade portion 40 in various configurations as described herein. The first linkages 27*a,b* are generally positioned on the second side 25 of the first blade portion 20 so as to be connected directly with corresponding second linkages 47*a,b* on the second side 45 of the second blade portion 40 when the present invention is in its straight-edge configuration. The third linkages 32*a,b* are positioned on the first side 24 of the first blade portion 20 so as to be connected directly with corresponding fourth linkages 52*a,b* on the first side 44 of the second blade portion 40 when the blade portions 20, 40 are switched to transition into the V-shaped blade configuration of the present invention.

The first linkages 27*a,b* may be comprised of various configurations, including the use of clips, brackets, clasps, and the like. In a preferred embodiment as shown in the figures, each of the first linkages 27*a,b* comprises a cylindrical receiver. The upper first linkage 27*a* is positioned adjacent to the upper end 22 of the first blade portion 20 at its second side 25. The lower first linkage 27*b* is positioned adjacent to the lower end 23 of the first blade portion 20 at its second side 25.

The first linkages 27*a,b* are vertically aligned along the second side 25 of the first blade portion 20. It should be appreciated, however, that the numbering, placement, and configuration of the first linkages 27*a,b* may vary in different embodiments and should not be construed as being limited by the exemplary figures.

The third linkages 32,*a,b* may also be comprised of various configurations, including the use of clips, brackets, clasps, and the like. In a preferred embodiment as shown in the figures, the upper third linkage 32*a* comprises a cylindrical receiver and the lower third linkage 32*b* comprises a slotted bracket. The upper third linkage 32*a* is positioned adjacent to the upper end 22 of the first blade portion 20 at its first side 24. The lower third linkage 32*b* is positioned adjacent at the lower end 23 of the first blade portion 20 at its first side 24.

The third linkages 32*a,b* are vertically aligned along the first side 24 of the first blade portion 20. It should be appreciated, however, that the numbering, placement, and configuration of the third linkages 32*a,b* may vary in different embodiments and should not be construed as being limited by the exemplary figures.

The first blade portion 20 will also include a first adjustment blade 30 which is slidably secured to a forward-facing surface of the first blade portion 20 as shown in the figures. The first adjustment blade 30 is locked in place against the first blade portion 20 using a first adjustment knob 34 which extends out of the first slot 26. By tightening the first adjustment knob 34, the first adjustment blade 30 may be locked in place to adjust the effective width of the present invention.

The first blade portion 20 may also include first and second mounts 28, 29 which aid in securing the first blade portion 20 to a mounting structure, such as a mount bar 60. Generally, the first mount 28 and second mount 29 will extend in spaced-apart relationship from the first blade portion 20 as shown in FIG. 1, with the first mount 28 being adjacent to the first side 24 of the first bucket portion 20 and the second mount 29 being adjacent to the second side 25 of the first bucket portion 20. The first and second mounts 28, 29 may comprise various configurations, including the bracket configurations shown in the figures.

Figure 2:
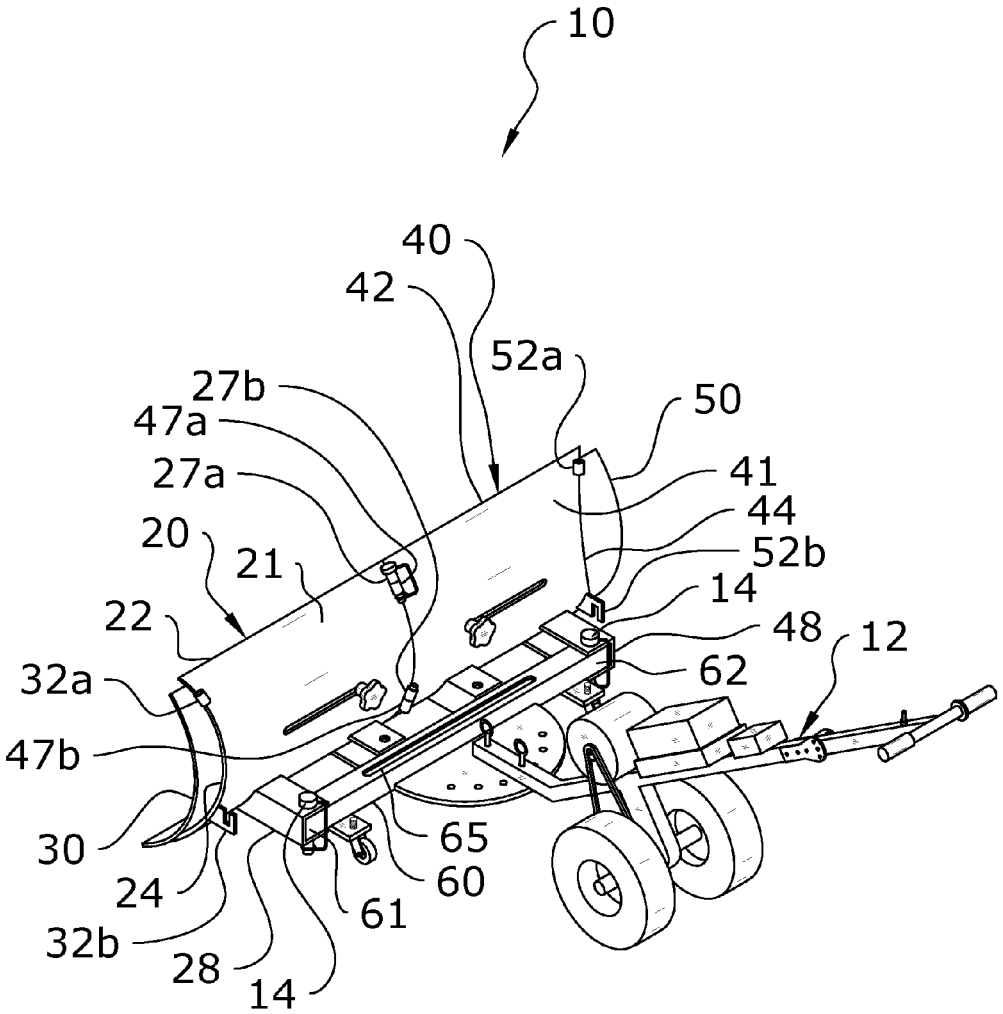
FIG. 2 is an upper perspective view of the present invention installed in a straight-blade configuration to a handheld snow plow.
Figure 4:
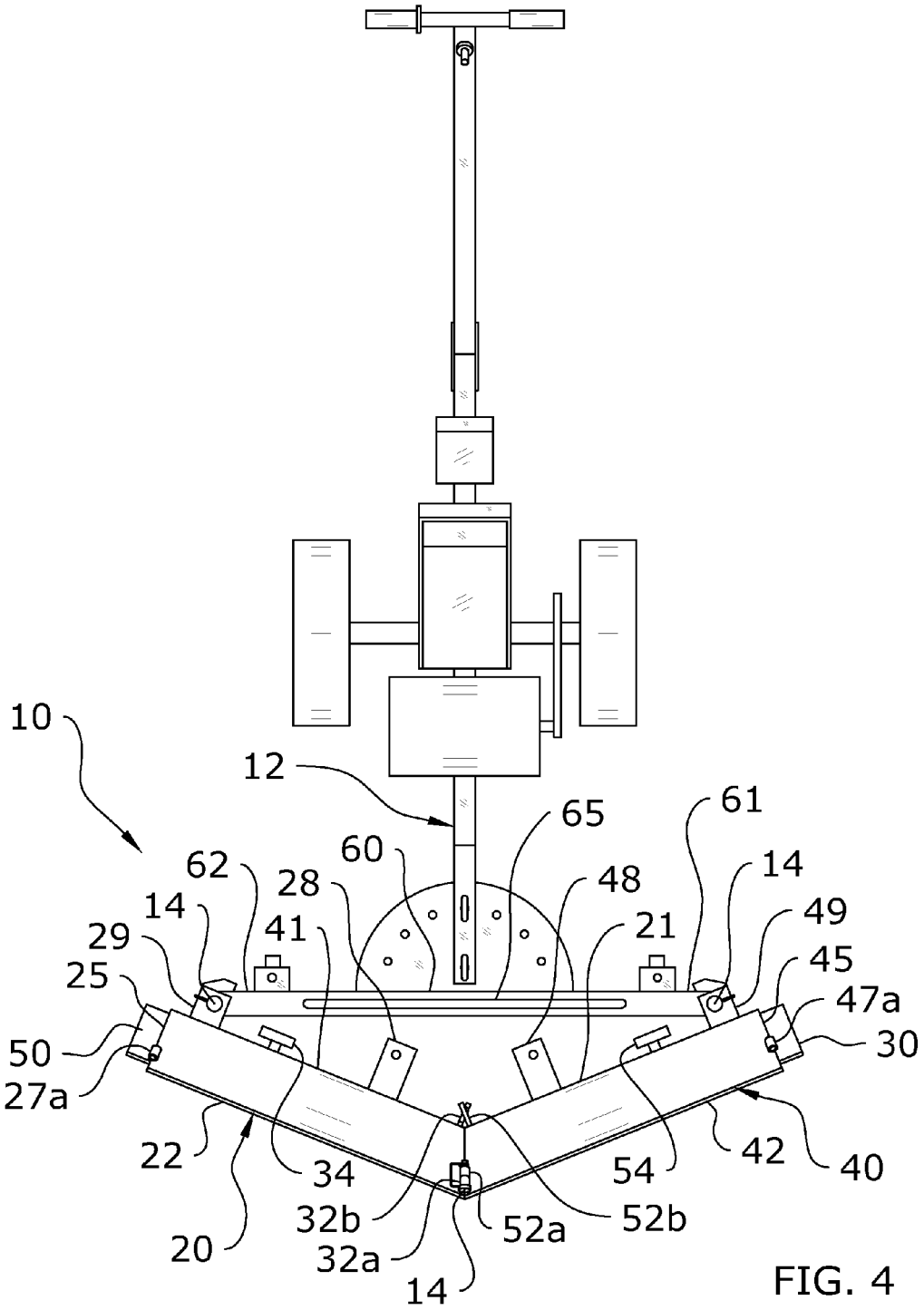
FIG. 4 is a top view of the present invention installed in a V-blade configuration to a handheld snow plow.

The first mount 28 is secured to the mount bar 60 when the present invention is in its straight-edge configuration as shown in FIG. 2. The second mount 29 is secured to the mount bar 60 when the present invention is in its V-blade configuration as shown in FIG. 4. Thus, the spacing of the first mount 28 with respect to the first side 24 of the first blade portion 20 is such that the first blade portion 20 may be aligned in a straight-edge configuration when the first mount 28 is connected to the mount bar 60. The spacing of the second mount 29 with respect to the second side 25 of the first blade portion 20 is such that the first blade portion 20 may be aligned in the V-blade configuration when the second mount 29 is connected to the mount bar 60. The second mount 29 includes a flattened portion extending from its lower end which rests underneath the mount bar 60 when in a straight-edge configuration.

As best shown in FIG. 5, the second blade portion 40 comprises a second blade backing 41 comprised of a curved blade configuration having an upper end 42, a lower end 43, a first side 44, and a second side 45. A second slot 46 extends through the second blade portion 40 between its first side 44 and its second side 45 in parallel relationship with the upper and lower ends 42, 43. The second slot 46 receives the second adjustment knob 54 of the second adjustment blade 40 and is utilized to make adjustments to the width of the adjustable plow blade 10.

The second blade portion 40 includes one or more second linkages 47*a,b* extending from its second side 45 and one or more fourth linkages 52*a,b* extending from its first side 44 for removably securing the second blade portion 40 to the first blade portion 20 in various configurations as described herein. The second linkages 47*a,b* are generally positioned on the second side 45 of the second blade portion 40 so as to be connected directly with corresponding first linkages 27*a,b* on the first side 24 of the first blade portion 20 when the present invention is in its straight-edge configuration. The fourth linkages 52*a,b* are positioned on the first side 44 of the second blade portion 40 so as to be connected directly with corresponding third linkages 32*a,b* on the first side 24 of the first blade portion 20 when the blade portions 20, 40 are switched to transition into the V-shaped blade configuration of the present invention.

The second linkages 47*a,b* may be comprised of various configurations, including the use of clips, brackets, clasps, and the like. In a preferred embodiment as shown in the figures, each of the second linkages 47*a,b* comprises a cylindrical receiver. The upper second linkage 47*a* is positioned adjacent to the upper end 42 of the second blade portion 40 at its second side 45. The lower second linkage 47*b* is positioned adjacent to the lower end 43 of the second blade portion 40 at its second side 45.

The second linkages 47*a,b* are vertically aligned along the second side 45 of the second blade portion 40. It should be appreciated, however, that the numbering, placement, and configuration of the second linkages 47*a,b* may vary in different embodiments and should not be construed as being limited by the exemplary figures.

The fourth linkages 52*a,b* may also be comprised of various configurations, including the use of clips, brackets, clasps, and the like. In a preferred embodiment as shown in the figures, the upper fourth linkage 52*a* comprises a cylindrical receiver and the lower fourth linkage 52*b* comprises a slotted bracket. The upper fourth linkage 52*a* is positioned adjacent to the upper end 42 of the second blade portion 40 at its first side 44. The lower fourth linkage 52*b* is positioned adjacent at the lower end 43 of the second blade portion 40 at its first side 44.

The third linkages 32*a,b* are vertically aligned along the first side 24 of the first blade portion 20. It should be appreciated, however, that the numbering, placement, and configuration of the third linkages 32*a,b* may vary in different embodiments and should not be construed as being limited by the exemplary figures.

The second blade portion 40 will also include a second adjustment blade 50 which is slidably secured to a forward-facing surface of the second blade portion 40 as shown in the figures. The second adjustment blade 50 is locked in place against the second blade portion 40 using a second adjustment knob 54 which extends out of the second slot 46. By tightening the second adjustment knob 54, the second adjustment blade 40 may be locked in place to adjust the effective width of the present invention.

The second blade portion 40 may also include third and fourth mounts 48, 49 which aid in securing the second blade portion 40 to a mounting structure, such as a mount bar 60. Generally, the third mount 48 and fourth mount 49 will extend in spaced-apart relationship from the second blade portion 40 as shown in FIG. 1, with the third mount 48 being adjacent to the first side 44 of the second bucket portion 40 and the fourth mount 49 being adjacent to the second side 45 of the second bucket portion 40. The third and fourth mounts 48, 49 may comprise various configurations, including the bracket configurations shown in the figures.

Figure 3:
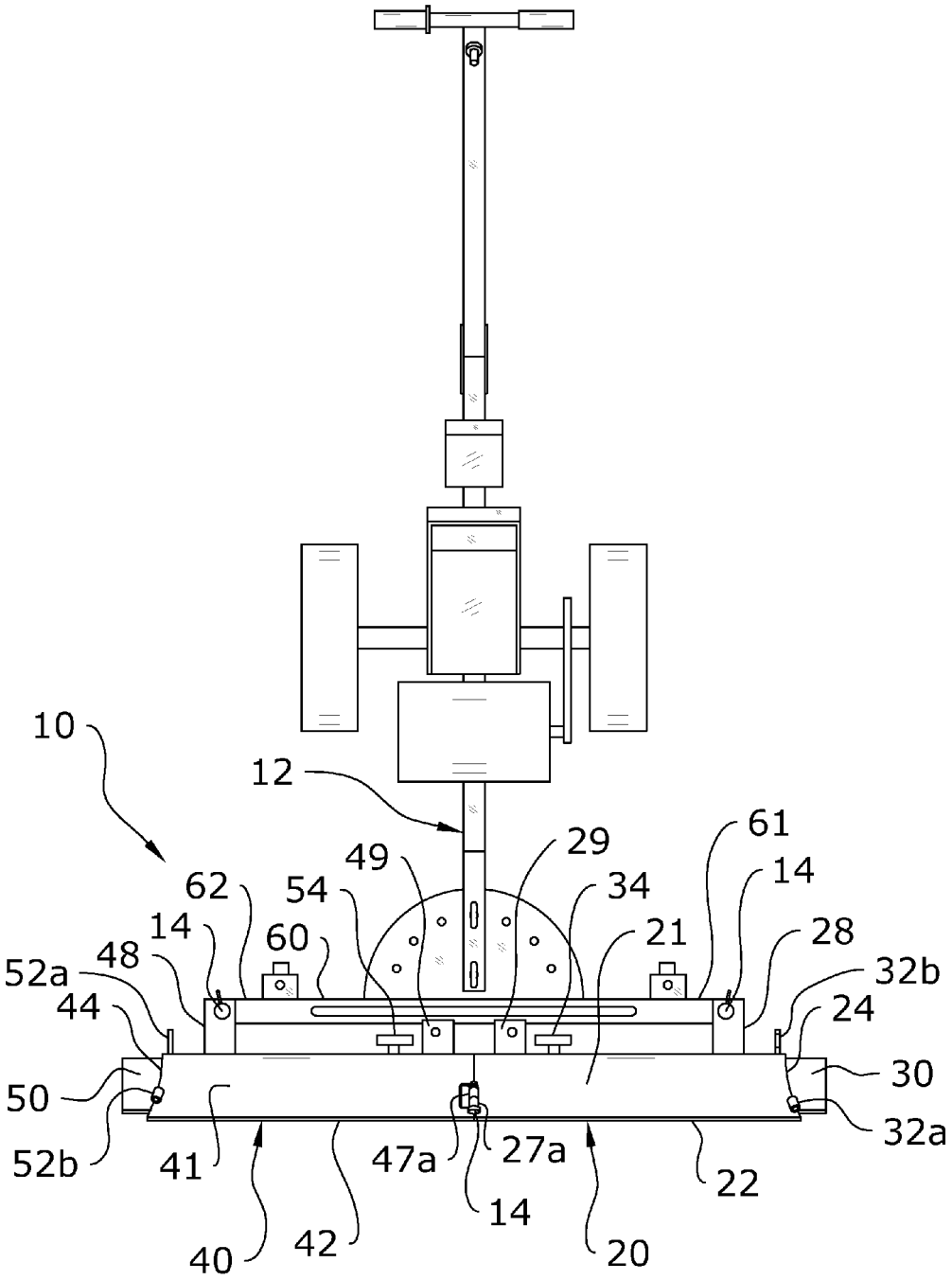
FIG. 3 is a top view of the present invention installed in a straight-blade configuration to a handheld snow plow.

The third mount 48 is secured to the mount bar 60 when the present invention is in its straight-edge configuration as shown in FIG. 3. The fourth mount 49 is secured to the mount bar 60 when the present invention is in its V-blade configuration as shown in FIG. 4. Thus, the spacing of the third mount 48 with respect to the first side 44 of the second blade portion 40 is such that the second blade portion 40 may be aligned in a straight-edge configuration when the third mount 48 is connected to the mount bar 60. The spacing of the fourth mount 49 with respect to the second side 45 of the second blade portion 40 is such that the second blade portion 40 may be aligned in the V-blade configuration when the fourth mount 49 is connected to the mount bar 60. The fourth mount 29 includes a flattened portion extending from its lower end which rests underneath the mount bar 60 when in a straight-edge configuration.

C. Mount Bar.

The plowing object 12 will generally include a mount bar 60 to which the present invention may be removably secured in a variety of configurations. The mount bar 60 is best shown in FIG. 1 and generally comprises an elongated member having a first end 61 and a second end 62. The first end 61 of the mount bar 60 includes a first aperture 63 and the second end 62 of the mount bar 60 includes a second aperture 64. A central slot 65 also extends between the first and second ends 61, 62 of the mount bar 60.

D. Operation of Preferred Embodiment.

The present invention is adapted for use with a wide range of plow objects 12, such as tools or vehicles. Tools may include snow blowers, handheld snow plows, and other handheld tools. Vehicles may include tractors, skid steers, bobcats, and the like. In any case, the blade portions 20, 40 are removably secured to the mount bar 60, with the mount bar 60 either being an integral part of or being connected to the plow object 12.

The present invention may be utilized in multiple configurations, including a straight-edge configuration shown in FIG. 2 and a V-shaped blade configuration shown in FIG. 4. To secure the present invention in the straight-edge configuration, the first mount 28 of the first bucket portion 20 and the third mount 48 of the second bucket portion 40 are secured to the first and second apertures 63, 64 of the mount bar 60 via fasteners 14. The second and fourth mounts 29, 49 will rest along the central portion of the mount bar 60 as shown in FIG. 3. The second side 45 of the second blade portion 40 is connected to the second side 25 of the first blade portion 20, such as by linking the first linkages 27*a,b* to the second linkages 47*a,b* to connect the blade portions 20, 40 together in the straight-edge configuration as shown in FIG. 3.

To convert into a V-shaped blade configuration, the blade portions 20, 40 are reversed, with the first side 24 of the first blade portion 20 being connected to the first side 44 of the second blade portion 40. When in such a V-shaped blade configuration, the third mount 29 of the first bucket portion 20 and the fourth mount 49 of the second bucket portion 40 are secured to the first and second apertures 64, 64 of the mount bar 60 via fasteners 14. The first and second mounts 28, 48 remain unconnected as shown in FIG. 4. The third linkages 32*a,b* are linked with the fourth linkages 52*a,b* to complete the V-shaped blade configuration as shown in FIG. 4.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An adjustable plow blade, comprising:

a first blade portion including a first side and a second side;

a second blade portion including a first side and a second side;

a first linkage on said second side of said first blade portion;

a second linkage on said second side of said second blade portion;

a third linkage on said first side of said second blade portion; and a fourth linkage on said first side of said second blade portion, wherein said first side of said first blade portion is adapted to be removably connected to said first side of said second blade portion by said third linkage and said fourth linkage to form a V-shaped blade configuration, wherein said second side of said first blade portion is adapted to be removably connected to said second side of said second blade portion by said first linkage and said second linkage to form a straight-edge blade configuration.

2. The adjustable plow blade of claim 1, further comprising a plurality of fasteners for removably securing said first linkage to said second linkage and said third linkage to said fourth linkage.

3. The adjustable plow blade of claim 1, wherein said first blade portion includes a first mount and a second mount.

4. The adjustable plow blade of claim 3, wherein said second blade portion includes a third mount and a fourth mount.

5. The adjustable plow blade of claim 4, further comprising a mount bar for removably and selectively securing to said first, second, third, and fourth mounts.

6. The adjustable plow blade of claim 5, wherein said mount bar includes a first aperture and a second aperture.

7. The adjustable plow blade of claim 6, wherein said first mount is removably secured to said mount bar via said first aperture and wherein said third mount is removably secured to said mount bar via said second aperture to form said straight-edge blade configuration.

8. The adjustable plow blade of claim 7, wherein said first aperture is positioned adjacent to a first end of said mount bar and said second aperture is positioned adjacent to a second end of said mount bar.

9. The adjustable plow blade of claim 7, wherein said mount bar includes a central slot.

10. The adjustable plow blade of claim 8, wherein said second mount is removably secured to said mount bar via said first aperture and wherein said fourth mount is removably secured to said mount bar via said second aperture to form said V-shaped blade configuration.

11. An adjustable plow blade system, comprising:

a plowing object;

a mount bar secured to said plowing object;

a first blade portion removably secured to said mount bar, wherein said first blade portion includes a first side and a second side;

a second blade portion removably secured to said mount bar, wherein said second blade portion includes a first side and a second side;

a first linkage on said second side of said first blade portion;

a second linkage on said second side of said second blade portion;

a third linkage on said first side of said second blade portion;

a fourth linkage on said first side of said second blade portion wherein said first side of said first blade portion is adapted to be removably connected to said first side of said second blade portion by said third linkage and said fourth linkage to form a V-shaped blade configuration;

wherein said second side of said first blade portion is adapted to be removably connected to said second side of said second blade portion by said first linkage and said second linkage to form a straight-edge blade configuration;

a first mount near said first side of said first blade portion;

a second mount near said second side of said second blade portion;

a third mount near said second side of said blade portion;

a fourth mount near said first side of said first blade portion;

wherein said first mount and said third mount are each removably secured to said mount bar when in said straight-edge blade configuration;

wherein said second mount and said fourth mount are each removably secured to said mount bar when in said V-shaped blade configuration; and a plurality of fasteners for removably securing said first linkages to said second linkages.

12. The adjustable plow blade of claim 11, wherein said plow object is comprised of a tool.

* * * * *